US009038857B2

(12) United States Patent
Chen

(10) Patent No.: US 9,038,857 B2
(45) Date of Patent: May 26, 2015

(54) DISPENSING CONTAINER

(71) Applicant: Fang-Pin Chen, Chia-Yi Hsien (TW)

(72) Inventor: Fang-Pin Chen, Chia-Yi Hsien (TW)

( * ) Notice: Subject to any disclaimer, the term of this patent is extended or adjusted under 35 U.S.C. 154(b) by 177 days.

(21) Appl. No.: 13/929,209

(22) Filed: Jun. 27, 2013

(65) Prior Publication Data

US 2014/0312073 A1 Oct. 23, 2014

(30) Foreign Application Priority Data

Apr. 22, 2013 (TW) ..... 102207267 U

(51) Int. Cl.
*B65D 35/56* (2006.01)
*B65D 35/14* (2006.01)
*B65D 35/10* (2006.01)

(52) U.S. Cl.
CPC ..... *B65D 35/14* (2013.01); *B65D 35/10* (2013.01)

(58) Field of Classification Search
CPC ..... B65D 37/00; B65D 35/56
USPC ..... 222/92–107, 214–215
See application file for complete search history.

(56) References Cited

U.S. PATENT DOCUMENTS

| | | | | |
|---|---|---|---|---|
| 2,476,446 | A | 7/1949 | Lindell | |
| 5,551,599 | A * | 9/1996 | Niss | 222/63 |
| 5,624,057 | A * | 4/1997 | Lifshey | 222/212 |
| 5,649,648 | A | 7/1997 | Lier et al. | |
| 5,799,829 | A | 9/1998 | Lier et al. | |
| 5,971,225 | A * | 10/1999 | Kapsa et al. | 222/212 |
| 6,269,837 | B1 * | 8/2001 | Arent et al. | 137/614.04 |
| 6,726,060 | B1 | 4/2004 | Ragusa et al. | |
| 7,014,068 | B1 * | 3/2006 | Cohen et al. | 222/321.9 |
| 7,766,190 | B2 * | 8/2010 | Chen et al. | 222/107 |
| 2003/0183639 | A1 * | 10/2003 | Winckels | 220/666 |
| 2012/0111894 | A1 * | 5/2012 | Bakhos | 222/209 |

FOREIGN PATENT DOCUMENTS

| | | |
|---|---|---|
| BE | 441309 | 5/1941 |
| CH | 227721 | 9/1943 |
| DE | 20 2010 001 345 | 7/2010 |
| EP | 2347961 | 7/2011 |
| FR | 612112 | 10/1926 |
| JP | 2006008170 | 1/2006 |

* cited by examiner

*Primary Examiner* — Paul R Durand
*Assistant Examiner* — Andrew P Bainbridge
(74) *Attorney, Agent, or Firm* — Dennis A. Gross

(57) ABSTRACT

A squeezable hollow thin walled dispensing container having an open ended main body is provided with a closure plug insertable into the open end, the plug having outwardly projecting ribs engaging the inside of the peripheral wall of the body, a locking member is received exterior of the body around the plug, and the plug and locking member entrapping portions of the wall therebetween to sealingly close the open end.

12 Claims, 3 Drawing Sheets

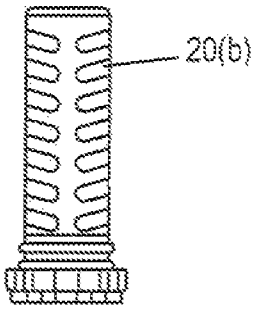
Fig. 5
Fig. 6
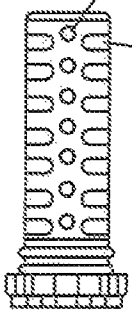
Fig. 7
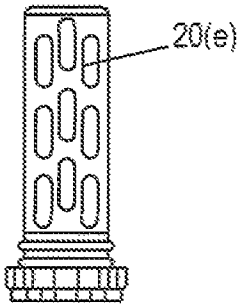
Fig. 8
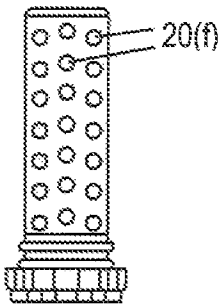
Fig. 9

DISPENSING CONTAINER

CROSS REFERENCE TO RELATED APPLICATION

Not Applicable

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable

MATERIAL SUBMITTED ON A COMPACT DISC

Not Applicable

BACKGROUND OF THE INVENTION

1. Field of the Invention

This invention relates to fluid dispensing devices having a body formed at least in part by a displaceable peripheral wall which can be displaced such as by squeezing to dispense contained fluid from a dispensing end of the body, the container being provided with an open bottom at an end opposite the dispensing end closed by a closure structure engaging the peripheral wall which structure can be applied after filling of the container.

2. Description of Related Art

Displaceable peripheral wall fluid dispensing containers where at least a portion of the wall is deformable inwardly to squeeze fluid from a dispensing opening are well known to the art. Such devices consist of both metal and plastic peripheral wall structures and are generally provided with a dispensing opening at one end and a filling opening at the other end. Often the dispensing opening is closed by a membrane which can be pierced to open a dispensing channel while the opposite end is, after filling, closed by crimping, folding or insertion of a plug, the plug procedure that is only effective when the peripheral wall's material at the open end is sufficiently distortion resistant to allow retention of plug. This can result in a stiffness of the wall which resists distortion making dispensing difficult.

While such dimensionally changeable peripheral wall dispensing containers have found use in products as diverse as cosmetics, toothpaste, calks, pharmaceuticals, adhesives, foods, and in general in most instances where a fluid can be extruded from the dispensing opening by squeezing the container or portions thereof.

FIELD OF THE INVENTION

It will be appreciated that the use of the term fluid is used in a broad concept and includes not only liquids but pastes, emulsions, compounds and other flowable materials. One common such use is found in dispensing containers for adhesives and in particular cyanoacrylate adhesives. Dispensing containers of the type described have included relatively stiff metal peripheral wall containers such as shown, for example in U.S. Pat. No. 4,649,648 where an extruded aluminum tube is provided having deformable sections and where an open end is closed by a plug inserted there into. Similar structures are found U.S. Pat. Nos. 5,799,829 and 6,726,060, the teachings of all of which are incorporated herein by reference. Such structures have been used for dispensing of cyanoacrylate adhesives and thread lockers. Such dispensers, whether formed as a round tube, or another shape such as oval or multi-sided, can have the open end generally opposite the dispensing opening closed by a plug if the material is stiff enough to allow the plug to be retained. One known technique is to form the plug with a mating shape portion for insertion into the open end and a larger end portion which abuts the end surface of the container. Thereafter, the peripheral wall can be constricted or deformed by known forming methods into tight engagement with the portion of the plug inserted into the interior of the container to seal the plug's periphery to the container's internal wall shape, for example by roll compression. The plug is normally made of a distortion resistant plastic compatible with the product to be dispensed. The end face of the plug can be used to provide a base surface to allow the dispenser to stand upright thus preventing the product contents from flowing out when the dispensing opening is not close.

Since well known to those skilled in the industry, however, the majority of the dispensing containers in use for the above mentioned products that rely upon a squeezable tube are made from either plastic which is then molded closed at the open end after filling, or which may be filled from the dispensing end after closure of the open end or are made from thin, non-brittle metal, normally aluminum or aluminum alloys and are closed at the filling, or open, end opposite the dispensing end by crimping the metal often after folding over a end portion.

A known disadvantage of such thin wall plastic and metal tubes is the fact that they can collapse intermediate the ends trapping material to be dispensed remote from the dispensing end and separated from that end by the collapsed section of the tube. A solution to that problem has been shown in my prior U.S. Pat. No. 7,766,190, the teachings of which are incorporated herein by reference, wherein I have provided an internal stiffener in the tube extending substantially along the length of the tube and having openings allowing fluid that becomes positioned between an outer diameter or exterior surface of the stiffener and the inner diameter of the tube to flow back into the interior of the stiffener.

While the structures shown in my aforementioned '190 patent aid in preventing collapse of the tube, immediate at its ends, the tube, particularly when the peripheral wall is formed of thin or weak materials such as aluminum or thin plastic must still be closed by a standard crimping action since the material, generally lacks sufficient strength to retain a plug inserted into the open end of peripheral wall.

It would therefore be an advance in the art if a method could be found to provide an internal stiffener insertable into an interior of a thin wall or weak distortable material container, where the tube can be provided with a plug type closure secure against leakage.

SUMMARY OF THE INVENTION

The present invention overcomes the deficiencies of the prior art by providing a deformable peripheral wall dispensing tube having an open end. A stiffener is inserted into the container from the open end, and a deformation resistant plug is provided for insertion into the open end. The plug has spaced raised portions having an outermost dimension greater than an interior dimension of the peripheral wall at the open end, the dimensional difference being relatively small whereby the plug may be forced into the open end providing an interference fit with the peripheral wall, thereby locally distorting the wall. A locking collar received around the peripheral wall has at least one internal reduced dimension area having an internal dimension approximately the same as the exterior dimension of the peripheral wall adjacent the open end. The collar may be forced to a position externally of the plug with the collar's reduced dimension section positioned in between the increased dimension portions of the plug with the peripheral wall entrapped therebetween, thereby providing a liquid seal preventing the contents from leaking from the open end by passage between the peripheral wall and the plug.

In an embodiment of the invention, a deformable wall hollow body dispensing container is provided with an interior stiffener having an integral plug formed at one end of the stiffener, the stiffener having an outer dimension sized to fit freely within an inner dimension of the container's hollow body, and the plug portion having an increased dimension outer portion terminating in an outer surface dimension greater than the container's inner surface cross sectional dimension in an area of the body adjacent the plug when the plug is inserted into an open end of the container whereby the plugs outermost dimension constitutes an interference fit with the container wall's inner dimension when the plug is fully seated blocking the open end of the container. The container is provided with a locking member effective to lock the plug in position within the container and to maintain a leak-resistant connection between the container's peripheral wall and the plug.

In an embodiment of the invention, a deformable dispensing container is provided having a peripheral wall formed of easily deformable metal or plastic, the peripheral wall defining an open end, a deformation resistant plug closing the open end, the plug having at least one raised peripheral section intermediate the distal ends of the plug increasing the periphery of the plug in a localized area to a dimension greater than the free cross section dimension of the interior of the container adjacent the open end, the container being provided with a locking member effective to constrain at least portions of the peripheral wall into sealed contact with the enlarged peripheral portion of the plug, the locking member effective to urge the plug in the container and to maintain a leak-resistant contact between the inner surface of the peripheral wall adjacent the plug and the outer surface of the plug.

In an embodiment of the invention, a generally cylindrical tube-like container has a reduced diameter dispensing end and a remote open filling end, the container having a body formed at least in part of a deformable material intermediate the dispensing end and the open end, the deformable material formed of a thin wall metal or soft plastic material, a deformation resistant plug closure for the open end having a generally cylindrical outer diameter which, intermediate ends of the plug, has at least one enlarged circumferential rib or bead having an outer diameter greater than the free inner diameter of the peripheral wall adjacent the open end whereby insertion of the plug into the open end creates a tight outer diameter to peripheral wall inner diameter contact at the raised rib, the container provided with a ring member having at least one inner diameter raised inwardly extending rib formed circumferentially thereabout having an inner diameter less than the outer diameter of the raised rib(s) on the plug, the ring being positionable around the container radially outwardly of the plug and the two ribs cooperating to entrap the material of the peripheral wall into sealing engagement between the plug outermost diameter and the peripheral wall inner diameter at the location of the rib.

In further modification of the preceding embodiment, the plug has an axial end having an enlarged diameter section positioned exterior of the container and a support surface allowing the container to stand upright with the dispensing end at the top.

In an embodiment of the invention, a squeezable dispensing container having a dispensing orifice at one end of a main body defined, at least in part, by a deformable peripheral wall, and an open end at an end of the body opposite the dispensing end is provided where the open end has a first internal diameter, a stiffener is received interior of the body providing resistance to collapse of the body under a squeezing pressure and a plug member insertable into the open end of the body having a plurality of spaced apart raised ribs having an O.D. greater than the I.D. of the body adjacent the open end is formed such that the peripheral wall at the open end is in snug contact with the raised ribs upon insertion of the plug. The plug having an enlarged diameter end having a diameter great than the O.D. of the body forming an abutment face for abutting the end of the body's peripheral wall when the plug is inserted into the container interior, a ring received around the body having at least one diameter reducing rib formed on an inner diameter thereof, the diameter reducing ribs having an inner diameter less than the outer diameter of the plug ribs and being positionable concentric with the plug with at least one of the ring's ribs positioned axially between two of the plug's ribs, whereby the peripheral wall in the area of the ring and the plug is radially deformed by the ribs to lock the plug to the container and to maintain a leak-resistant relationship between the plug outer diameter and the peripheral wall inner diameter.

In a further modification of the above embodiment, the plug and stiffener are attached together with the plug positioned at one end of the stiffener.

In a further modification of the above modification, the plug and stiffener are formed together and the plug has a U-shaped groove formed in its enlarged diameter section exterior of the tube, the groove dimensioned to receive an axial end portion of the ring to properly position the ring with respect to the plug by abutment with the bottom of the groove.

In another modification of the above mentioned embodiments, both the plug and the ring are provided with a plurality of spaced ribs whereby the peripheral wall portions entrapped between the fully seated ring, and the plug and has a plurality of axially spaced alternating circumferential distortions to seal the wall to the O.D. of the plug.

It will be appreciated by those of ordinary skill in the art that the above summary of the invention can undergo extensive modifications and that when the container is described as generally tubular or cylindrical that other shapes may be provided and that the dimensional relationships described between the plug, the peripheral wall and the ring may be changed.

BRIEF DESCRIPTION OF THE DRAWINGS

FIGS. 5-9 show alternative forms of the stiffener-plug combinations.

DETAILED DESCRIPTION OF THE INVENTION

FIGS. 1-4 illustrate one preferred form of this invention although it will be apparent that many different embodiments may be utilized in the practice of this invention. For example, FIGS. 1-4 illustrate the container as being substantially tubular and having a reduced diameter dispensing end and a generally cylindrical body. As will be appreciated by those skilled in the art, the actual geometric construction of the container may be varied and component parts of it may be varied in shape, position, construction, and dimension. For example, the main body may have different shapes, both in its entirety such as oval or multi-sided, or may have different shapes for different portions for the container body. Similarly, the portion of the container referred to herein as a stiffener 18 and shown as a generally tubular body could take other shapes and could, for example, have a circumferential discontinuities for all or a portion of the length of the stiffener with the exception of a ribbed bottom portion forming a plug 25.

Figure 1:
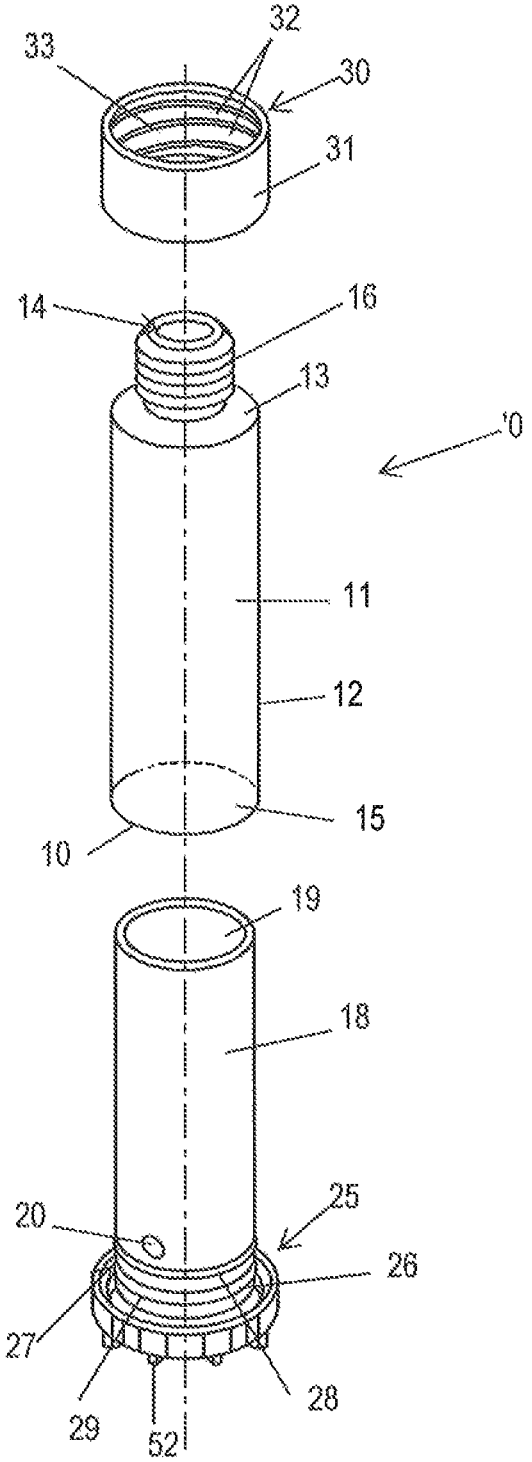
FIG. 1 is an exploded view of a tube shaped dispensing container according to this invention.

As shown in FIG. 1, the container 10 may be constructed of a main body portion 11 defined by a peripheral wall 12 which may be necked down at one end 13 to form a dispensing opening 14 which may consist of an axially extending reduced diameter threaded section. The opening may be closed by a membrane 70 which may thereafter be pierced to open the end 14 to the interior of the main body 11 and/or the stiffener 18. It will be appreciated that threading is optional and that different cap designs may be provided for the dispensing end, including dispensing caps not requiring a threaded connection.

The peripheral wall 12, for at least a portion of its length, including a portion adjacent an open bottom end 15, is formed of a deformable material. Preferred materials are aluminum, aluminum alloys, other thin metals such as copper, copper alloys and plastics, all of which are well known in the squeezable dispensing container art. Although FIGS. 1-4 show the body 11 to have a consistent thickness of the peripheral wall 12 from the portion 13 to the open end 15, variations in thickness and stiffness of the peripheral wall may be provided if desired. For example, the portion 13 as well as the threaded section 16 leading to the dispensing opening 14 may, all or in part, be provided of thicker and/or stiffer materials choices whereby the dispensing end will not be easily distortable.

Ease of distortion of the peripheral wall 12 is an important consideration for at least a portion for the wall, thereby allowing the contents to be dispensed by squeezing the container's outer surface to reduce the interior dimension of the container body 11.

As is known, from amongst other sources, the above mentioned patents, the interior of the body 11 may be provided with a stiffener such as 18 which is open at at least one end 19 and which is dimensioned to be received with clearance interior to the body 11. The stiffener is usually made of a resilient material so as to return the deformable peripheral wall 12 to a shape close to its undeformed, free condition after squeezing. The stiffener, however, is designed to be compressible so as to allow squeezing to reduce the interior dimension of the inside of the main body 11 which may, for substantial portions of its length be defined by the interior of the stiffener 18. The degree of stiffness provided by the stiffener can be chosen with respect to the materials to be dispensed from the container. For example, when the container is used to dispense adhesives and in particular cyanoacrylate adhesives where only a small drop or two may be desired to be dispensed at each use, the stiffener 18 may be relatively stiff and compression resistant to prevent over dispensing while squeezing. For other products that may be dispensed, where a greater quantity per dispense is desired or where the product is thicker, such as toothpaste, the stiffener may be less resistant to compression to facilitate a greater and perhaps longer container body constriction.

As shown in FIG. 1, the stiffener is preferably provided with at least one opening 20 extending through the wall of the stiffener. This opening permits flow of the contained product from a space between the stiffener outer diameter and the body 11 inner diameter back into the interior of the stiffener.

As shown in FIGS. 5-9 the arrangement of the opening 20 may vary as shown at 20(*a*)-20(*f*). Variations on those opening configurations may also be chosen.

Figures 2, 3, 4:
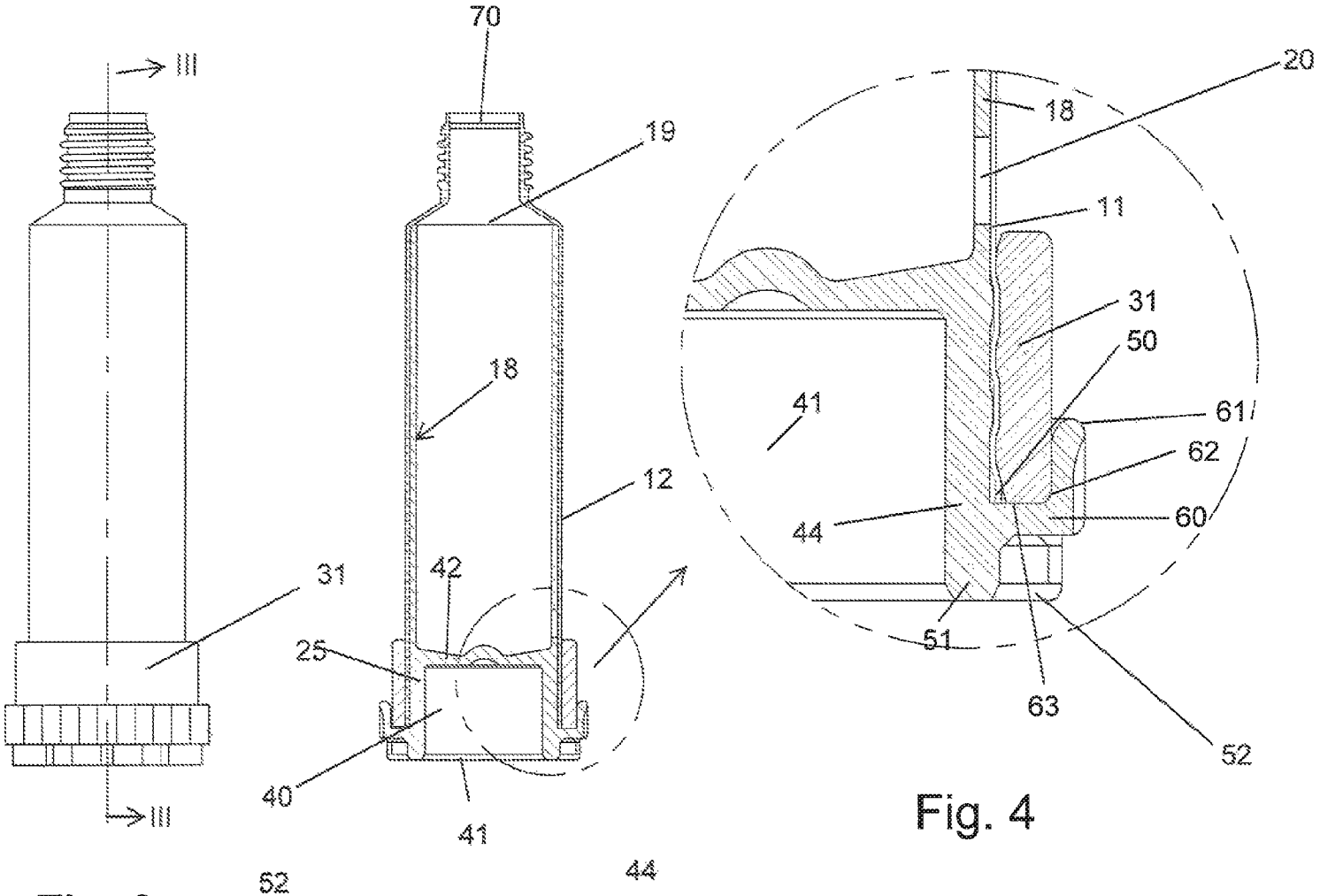
FIG. 2 is an exterior side view of the dispensing container according to this invention formed as a tube.
FIG. 3 is a cross section of the tube of FIG. 2 taken along the line iii-iii of FIG. 2.
FIG. 4 is an enlarged partial sectional view of the indicated portion of FIG. 3.

As shown in FIGS. 1 and 3 and in FIGS. 5-9, a bottom section 25 of the stiffener may be provided as a plug 26 for insertion into the open end 15 of the body 11. In the figures, the plug 26 is shown as formed integrally with the stiffener 18, however it will be understood that this is only a preferred structure and that the plug can be formed as a separate element apart from the stiffener. Many of the benefits derived from this invention can be obtained utilizing a plug separate from the stiffener, or even eliminating the stiffener 18 in whole or in part and utilizing a more resilient material for the peripheral wall 12.

The plug portion 26 has an outer diameter section 27 which is provided with a plurality of raised circumferential ribs 28 which are axially spaced apart forming recesses or grooves 29 between the ribs circumferentially of the plug. The outer diameter of the ribs is preferably greater than the inner diameter of the peripheral wall 12 of the body 11 adjacent the open end 15. Thus, when the ribbed section of the plug is inserted into the open end 15, after filling of the container, the peripheral wall 12 will be stretched to accommodate the plug. Preferably the plug is formed of a more compression resistant material compared to the material of the wall 12 such that the dimensions between the inner diameter of the peripheral wall 12 and the outer diameter of the ribs 28 will create an interference fit between the peripheral wall 12 and the plug's ribbed area.

A locking member 30 is provided which may be in the shape of a ring 31 having an axial length slightly greater than the axial length of the ribbed area of the plug and an inner diameter which consists of one or more diameter reducing ribs 32 spaced apart by grooves 33. The inner diameter of the ribs 32 is the same as or slightly larger than the outer diameter of the peripheral wall 12 at least adjacent the bottom 15 to allow the ring to be slipped along the body 11 or at least along a bottom portion.

The inner diameters of the locking member 30's ribs 32 are slightly less than the outer diameter of the ribs 28 of the plug, and the groove(s) 33 have a bottom diameter slightly greater than the ribs 28 of the plug. Inversely the groove(s) 27 of the plug have a groove bottom minimum diameter less than the inner diameter of the ribs 32 of the ring 31. These diameter relationships are chosen with respect to the thickness of the peripheral wall 12 so as to snugly entrap or even slightly compress the peripheral wall between the ribs and grooves of the ring and the plug in a sealing relationship between the inner diameter of the peripheral wall 12 and the outer diameter of the plug 25.

It will be appreciated that the locking member, when formed as a ring 31, may be assembled by moving it along the length of the body 11 and forcing it into coaxial circumferential alignment with the plug, or if the dimensioning of the body 11 changes along its axial length the ring 11 could be positioned adjacent the opening 15 spaced sufficiently above it so that the plug can be inserted. Because the plug and the ring are generally chosen of stiff materials, and because of the overlapping between the inner diameter ribs of the locking member ring 31 and the outer diameter ribs 28 of the plug, a condition made dimensionally more important due to the presence of the peripheral wall 12 at the time the locking member is positioned around the plug, it is preferable if either the plug or the ring or both have some resiliency to allow seating of the ring in position.

As is best shown in FIGS. 3 and 4, this can be partially facilitated by providing the plug portion 25 with a hollow interior 40 extending from an open plug bottom 41 to a closed plug top 42. The hollow interior 40 is defined by a peripheral wall 44 which extends beyond the bottom 50 of the wall 12 of the body 11. The preferably circumferential wall 44 of the plug extends beyond the end 50 and terminates in an end surface 51 exterior of the container. The surface 51 which may have extensions thereof of which may be circumferentially discontinuous as shown as 52 provides a base on which the container can be supported on a surface in an upright position. The base provides support for the container to maintain the dispensing orifice end upright. This represents an advance over prior distortable or compressible containers which generally rest sideways on a surface and may leak if not capped. This upright positioning of the container of this invention is facilitated by reason of the stiffener and its ability to return the container wall to its uncompressed position, or substantially so, such that the center of gravity is generally axially positioned along the length of the container.

As shown in FIG. 4 the peripheral wall 11 will become distorted in a serpentine fashion as the ribs of respectively the plug and locking member ring 31 bend the wall 11 into seated position in the respective grooves of the plug and the ring which lie radially opposite the associated ribs.

In order to properly position the ring the plug may have a radially extending collar 60 which is open at its top 61 to provide a groove 62 receiving the bottom axial end of the ring 31. That collar may flare outwardly at the top 61 providing a guiding lip to guide the ring into fully seated position. The bottom 63 of the groove 62 provides a stop for movement of the sleeve during assembly of the sleeve into its operative position with its ribs aligned with the plug's grooves and the plug's ribs aligned with the ring's grooves and further provides a stop for the plug during insertion of the plug as the open end 50 of the container defined by the peripheral wall 12 contacts the bottom of the groove 62.

It will therefore be seen that this invention provides an improvement over the prior art of thin wall squeezable or collapsible tubes or dispensing containers by providing a plug closure to an open filling end of the container which, in cooperation with a locking member, securely seals the interior of the container against leakage at the open end when the plug is inserted and the locking member positioned properly. This is accomplished by providing a sealing fit by entrapping a peripheral wall of the container between the locking member and the plug, with the locking member on the outside of the peripheral wall and the plug on the inside of the peripheral wall. In a preferred embodiment the plug and the locking member are each provided with circumferential alternating ribs and grooves so as to firmly lock the plug in place in the container and to alternately constrict and expand the wall of the container into sealed engagement with the plug's outer dimension.

Although the invention has been shown in connection with a preferred embodiment, numerous modifications of that embodiment are easily made by persons of ordinary skill in the art without losing the benefit of the invention. For example, the groove 62 could be eliminated and the ring 31 simply bottomed against an outwardly extending portion 60 of the plug which can also service as the contact between the end 50 and the plugs enlarged diameter bottom support. Alternatively the ring and the plug could be dimensioned other than cylindrical, for example by tapering utilizing a opposed tapers or by other dimensional changes. The ribs and grooves could be increased or reduced in number and in dimension, and depending upon the constrictive resiliency of the ring and the stiffness of the plug the ribs and grooves could be eliminated. Other modifications may also be made without parting from the spirit of this invention.

I claim as my invention:

1. A dispensing container having a hollow body having a reduced interior dimension dispensing end portion and an opposite second end portion with an enlarged, with respect to the dispensing end's interior dimension, a main body portion extending between the end portions, the second enportion comprising an open end remote from the dispensing end, and the main body defined by a peripheral wall having an interior surface extending between the end positions, the peripheral wall adjacent to the open end having a first interior cross section minimum dimension defined by an interior surface, a plug having a length and having an outer surface having an exterior cross section dimension for at least a portion of its length which is larger than the first interior cross section minimum dimension, the plug, configured to be inserted into the open end in contact with at least portions of the interior surface of the peripheral wall near the second end and a moveable locking member received around an exterior of around the peripheral wall aligned with the plug engaging at least portions of the exterior of the peripheral wall near the second end maintaining the interior surface portions in sealing contact with portions of the plug outer surface, the plug having an end portion remote from the dispensing end positioned exterior of the boby extending beyond the open end of the body, the plug end portion comprising a surface configured to support the container in an upright position with the dispensing end at an upper position and the plug end portion at a bottom portion whereby after opening the dispensing end to the body interior the container can be set upright on a surface with the plug end surface supporting the container with the dispensing end at the top of the upright container.

2. The container of claim l wherein the plug has at least one projecting outer rib and the locking member has at least one inner extending groove alignable with the rib to entrap a portion of the peripheral wall in the groove.

3. The container of claim 2 wherein the body, plug and the locking member are generally cylindrical and the plug and the locking member have a plurality of respectively outer diameter and inner diameter ribs defining grooves therebetween whereby a portion of the peripheral wall adjacent the open end circumferentially surrounds the plug and has an axially extending portion having a serpentine section alternatingly projecting outward into a groove of the locking member and inwardly into a groove of the plug.

4. A dispensing container according to claim 3 wherein the container is provided with a stiffener interior of the main body.

5. The container of claim 4 wherein the plug and the stiffener are joined together.

6. The container of claim 5 wherein the plug and the stiffener are integrally formed and wherein the plug has an increased diameter axial end portion extending axially beyond the peripheral wall providing a support surface for supporting the container in an upright position with a dispensing end of the main body remote from the plug positioned remote from the support surface.

7. A dispensing container comprising a hollow main body having a dispensing end adjacent one end thereof and an open end at the other end thereof, the main body being formed of distortable material permitting at least portions of the main body to be collapsed inwardly by squeezing to reduce an interior dimension of the main body, a resilient stiffener received interior of the main body resisting inward distortion of the portions of the main body, a plug closing the open end, the plug having an outer periphery in circumferential contact with an inner periphery of at least an end portion of the main body, and a locking member received exterior of the main body, axially aligned with at least portions of the plug and effective to maintain a sealing contact between sealing portions of the end portion of the main body and peripheral portions of the plug, the sealing portions of the main body being positioned intermediate the periphery of the plug and an inner periphery of the locking member, the plug extending beyond the open end away from the main body and terminating in a flat surface having a larger diameter than the main body and the open end, the flat surface configured to support the container in an upright position with the dispensing end at the top.

8. The container of claim 7 wherein the plug and the locking member have respectively spaced apart peripheral outwardly projecting ribs and spaced apart peripherally inwardly projecting ribs, the spaced apart ribs defining grooves therebetween.

9. A dispensing container having a tubular main body formed of an easily distortable material, the main body having an axially extending hollow interior bounded at a one end by a dispensing structure and at the other end by an open end having an outer diameter, the open end being closed by a plug inserted into the open end after filling of the container, the plug having circumferential outer diameter projecting ribs forming at least one groove therebetween, the ribs having an outer diameter greater than an inner diameter of the portions of the main body defining the open end whereby portions of the main body defining the open end are distorted by insertion of the plug into the open end and are in sealing contact with the plug ribs, a locking ring received around the main body portion surrounding the inserted plug, the locking ring having a plurality of inner diameter reducing circumferential ribs defining at least one groove therebetween, the ribs of the locking ring and the ribs of the plug effective to distort the portion of the main body at or near the open end into the grooves and in sealing contact with the outer diameter of the plug, the plug having an enlarged end surface positioned exterior of the container main body axially beyond the open end having an outer diameter greater than the distorted open end, the enlarged axial end portion of the plug forming a generally flat support surface generally normal to the axis of the man body allowing the container to be stably positioned on a surface with the dispensing end remote from the surface.

10. The container of claim 9 including a stiffener positioned interior of the main body, the stiffener having a hollow interior portion defined by at least one wall, at least one opening through the at least one wall from an interior thereof to an exterior thereof.

11. The container of claim 10 wherein the stiffener and plug are integral with the plug forming an axial end of the stiffener opposite the dispensing end.

12. The container of claim 10 wherein the enlarged end portion includes a radially extending collar terminating in an axially extending wall forming a top opening from which receives an axial end of the locking ring position, the locking ring axially with respect to the plug.

* * * * *